United States Patent [19]

Atchisson

[11] 3,964,173

[45] June 22, 1976

[54] ADJUSTABLE SIGHT FOR FIREARM APPARATUS

[76] Inventor: Maxwell G. Atchisson, 55 Old Yellow Springs Road, Apt. H, Fairborn, Ohio 45324

[22] Filed: Nov. 18, 1974

[21] Appl. No.: 524,522

Related U.S. Application Data

[62] Division of Ser. No. 250,006, May 3, 1972, Pat. No. 3,850,076.

[52] U.S. Cl. ..... 33/254

[51] Int. Cl.[2] ..... F41G 1/18; F41G 1/28

[58] Field of Search ..... 33/254, 255, 256, 257, 33/258

[56] References Cited

UNITED STATES PATENTS

| | | | |
|---|---|---|---|
| 920,767 | 5/1909 | Lindberg | 33/255 |
| 1,715,203 | 5/1929 | Loomis | 33/254 |
| 2,806,288 | 9/1957 | Sarvis | 33/254 |

FOREIGN PATENTS OR APPLICATIONS

| | | | |
|---|---|---|---|
| 60,062 | 4/1891 | Germany | 33/254 |

*Primary Examiner*—Richard E. Aegerter
*Assistant Examiner*—Richard R. Stearns
*Attorney, Agent, or Firm*—Jones, Thomas & Askew

[57] ABSTRACT

A ramp-type sight for a firearm such as a rifle. The sight has a fixed plane member defining a ramp, and a movable plane member which slides along the ramp and which carries a visual sighting member such as a peep sight. The movable member contains a number of contiguous openings which overlap one another along a linear path, and a member having a conical surface is resiliently urged into the contiguous openings, so that each opening provides a click-type elevation adjustment for the movable member.

4 Claims, 11 Drawing Figures

ADJUSTABLE SIGHT FOR FIREARM APPARATUS

This is a division of application Ser. No. 250,006, filed May 3, 1972, now U.S. Pat. No. 3,850,076.

The present invention relates in general to firearm apparatus and in particular to a firearm having improved sight apparatus permitting elevation adjustment.

While firearm sights are known which permit elevation adjustments to be made, including various types of ramp sights, such sights of the prior art generally require precision machined surfaces and are, consequently, relatively extensive to manufacture.

It is object of the present invention to provide improved sight apparatus for use with a firearm.

It is another object of the present invention to provide improved and simplified ramp sight apparatus providing click-stop adjustment.

Other objects and many of the attendant advantages of the present invention will become apparent from the following description of a disclosed embodiment of the invention, including the following drawings, in which.

A rear sight is provided including an adjustment feature utilizing a plurality of contiguous intersecting apertures, and having means for selectively engaging a selected said aperture.

Figure 1:
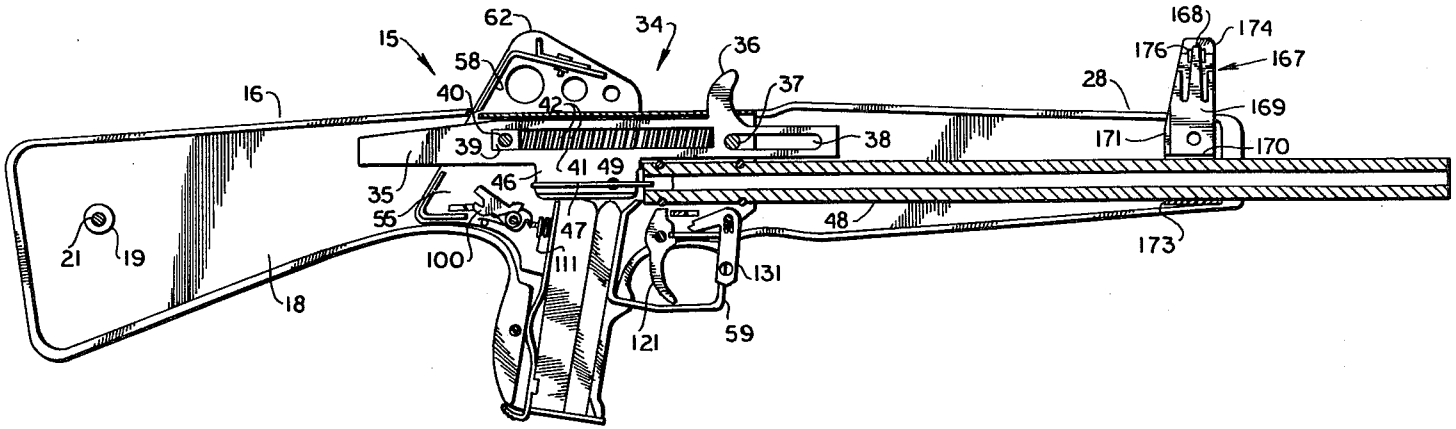
FIG. 1 shows a partially sectioned elevation view of a rifle according to a disclosed embodiment of the present invention.
Figure 2:
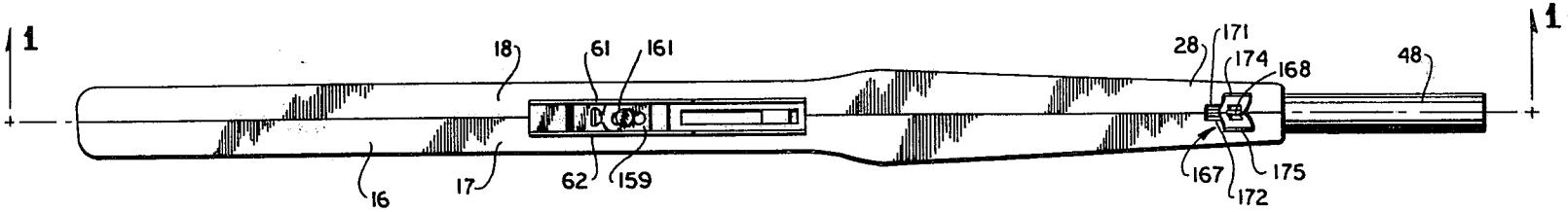
FIG. 2 shows a plan view of the rifle shown in FIG. 1.

Stated more particularly and with reference taken to the Figures, the disclosed embodiment of the present invention as particularly seen in FIGS. 1 and 2 includes a rifle indicated generally at 15 and of the type known as a carbine. The rifle 15 includes a stock 16 advantageously formed of two halves 17 and 18 which envelope most of the receiver and the barrel, as pointed out below. The halves 17 and 18 of the stock may be molded from a suitable plastic material having the desired resistance to physical stress and the like. The two halves of the stock 16 may be secured together at two or more locations, one of which is shown in FIG. 1 and is detailed in FIG. 6, including a pair of bosses 19 and 20 extending to provide the proper spacing between the two halves of the stock. A suitable fastening member such as the bolt 21 extends through aligned openings in the bosses 19 and 20. The opening through the boss 20 has a threaded portion 22 for engagement with the threaded portion 23 of the bolt 21, and has an unthreaded remainder portion 24 of sufficient diameter to permit free passage of the bolt threaded portion 23. The opening 25 extending through the boss 19 is threaded along a portion of its length. The presence of the unthreaded portion 24 enables the stock halves 17 and 18 to be separated by unscrewing the threaded portion 23 of the bolt from the corresponding threaded portion 22, thereby enabling the bolt to be removed from the threaded portion 22 of the opening while selectively retaining the bolt 21 in captivity on the stock half 18.

Figure 6:
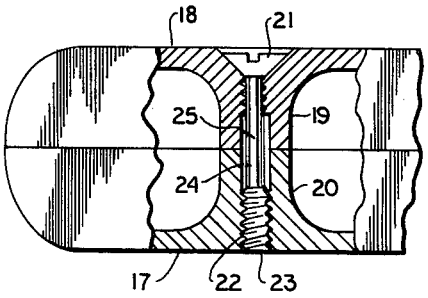
FIG. 6 is a section view taken along line 6—6 of FIG. 1 and illustrating an interconnection between the halves of the stock according to the present embodiment.
Figure 7:
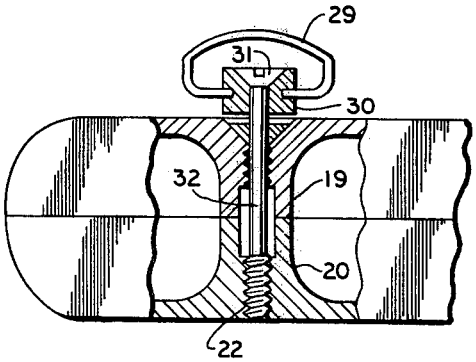
FIG. 7 is a section view showing an alternative to the stock interconnection of FIG. 6 and including a loop for attaching a sling.

Although only a single stock connecting location is shown on the drawings, it will be understood that at least one other such connection is provided preferably at a location adjacent the front end 28 of the stock. If it is desired to equip the rifle 15 with a sling, the necessary sling connection may advantageously be provided as shown in FIG. 7, by removing each bolt 21 and substituting a swivel connector including a sling loop 29 mounted in a bushing 30 retained against the stock by a bolt 31 which differs from the bolt 21 primarily in the provision of an elongated shank 32. In this way, a rifle according to the present invention can be normally furnished to all users having the stock interconnection as shown in FIG. 6, and can be rapidly and inexpensively converted to receive a sling without required drilling and with only a conventional screwdriver.

Returning to FIG. 1, the rifle 15 includes a receiver section shown generally at 34 and including a bolt member 35 positioned therein. The bolt member 35, which includes a cocking member 36 extending outwardly of the receiver section and the stock 16, is mounted for reciprocal movement by a first member such as the dowel pin 37 extending through a first slot 38 in the bolt member, and by a second member such as a second dowel pin 40 extending through a bolt bushing 39 slidably received within a second slot 41 of the bolt member. The bolt member 35 is normally maintained in the fully-forward position by an operating spring such as the compression coil spring 42 disposed in the second slot 41 to interact between the bolt bushing 39 and end of the slot.

The bolt member 35 includes a cartridge moving member 46 which extends downwardly from the remainder of the bolt member and on which is positioned the firing pin/extractor 47. The construction and operation of the cartridge moving portion 46 and the firing pin/extractor 47 is discussed in detail below.

The rifle 15 includes a rifle barrel 48 having a cartridge-receiving chamber 49 positioned immediately adjacent the front face 50 of the cartridge moving member 46.

Figure 5:
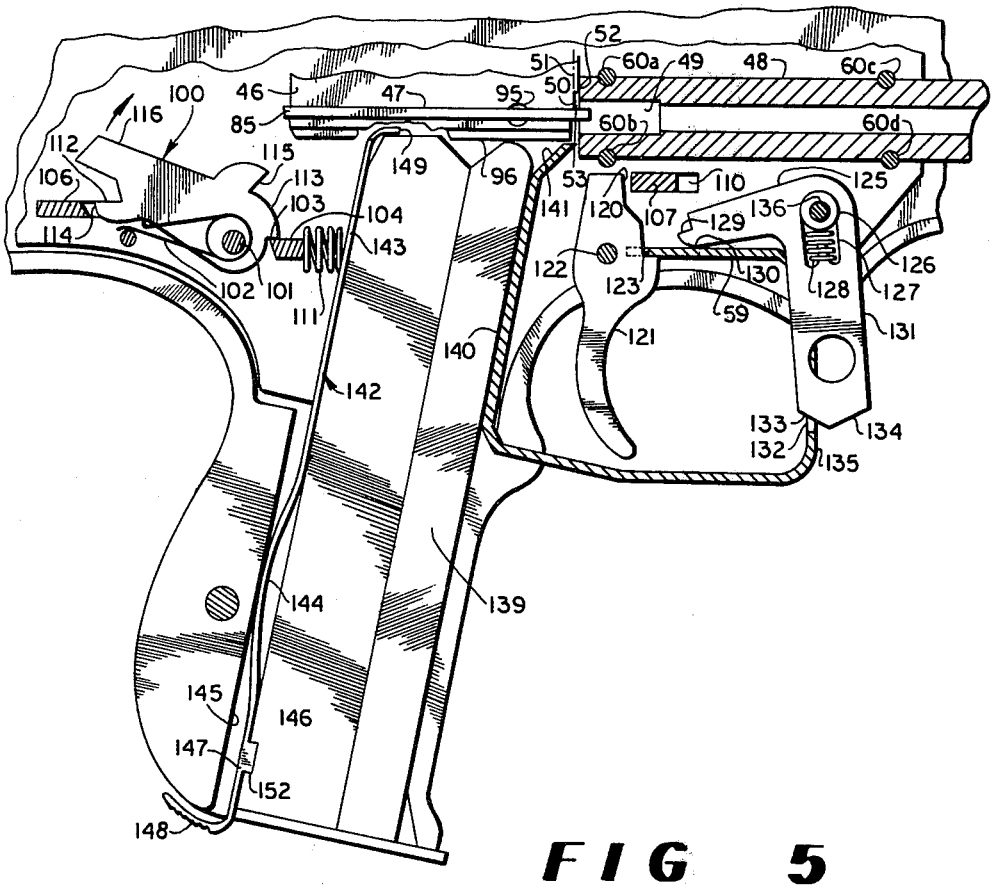
FIG. 5 is a partial section view showing details of the firing mechanism, the safety, and other features of the disclosed embodiment.

It is particularly apparent in FIGS. 1 and 5 that the front face 50 includes a portion defining a surface 51 which is spaced forward a predetermined distance relative to the front face 50. The normal position of the bolt member 35 in the full-forward position defined by engagement of the dowel pin 37 with the back end of the first slot 38, under the influence of the spring 42, is selected with reference to the positioning of the barrel 48 to provide a small amount of clearance at 53 between the surface 51 and the chamber end 52 of the barrel. It will be understood by those skilled in the art that the head spacing clearance 53 defined between the front face 50 of the cartridge moving member 46 and the chamber end 52 of the barrel must be suited to the rim of the particular cartridge for which the rifle is chambered. It will be seen that the disclosed embodiment of the present invention is chambered and otherwise designed for the .22 caliber rimfire cartridge.

Figure 3:
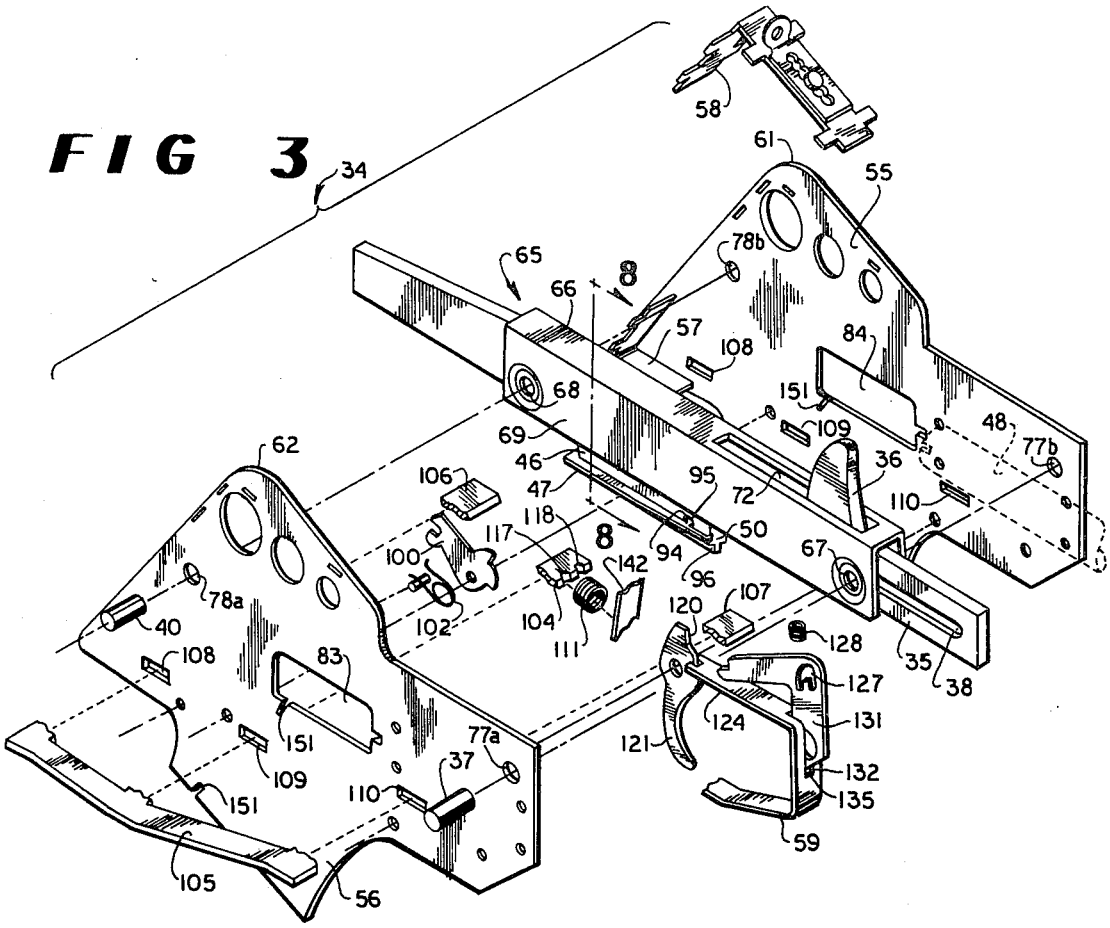
FIG. 3 shows an exploded view of the receiver assembly of the disclosed embodiment.

The exploded view of FIG. 3 shows in detail the receiver section 34, which includes a pair of spaced-apart receiver plates 55 and 56 which may be identical in configuration and which may be advantageously manufactured by a suitable stamping operation. The desired spacing between the receiver plates 55 and 56 is maintained by spacing elements 57 and 58, by the trigger guard 59, and by the barrel 48; the spacing elements 57 and 58 are depicted as having tab-and-slot interconnection between the two receiver plates, and it will be understood that this interconnection may be supplemented or provided by permanent fastening techniques such as welding, riveting, or the like. The chamber end of the rifle barrel 48, which may be secured between the receiver plates 55 and 56 by rivets 60*a*, 60*b*, 60*c*, and 60*d*, also functions to maintain the spacing between the receiver plates. The receiver plates 55 and 56 protrude upwardly from the stock 16 to form the ears 61 and 62, and the spacing element 58 positioned between the ears also functions as a base for the rear sight, as set forth below.

BOLT ASSEMBLY

Figure 4:
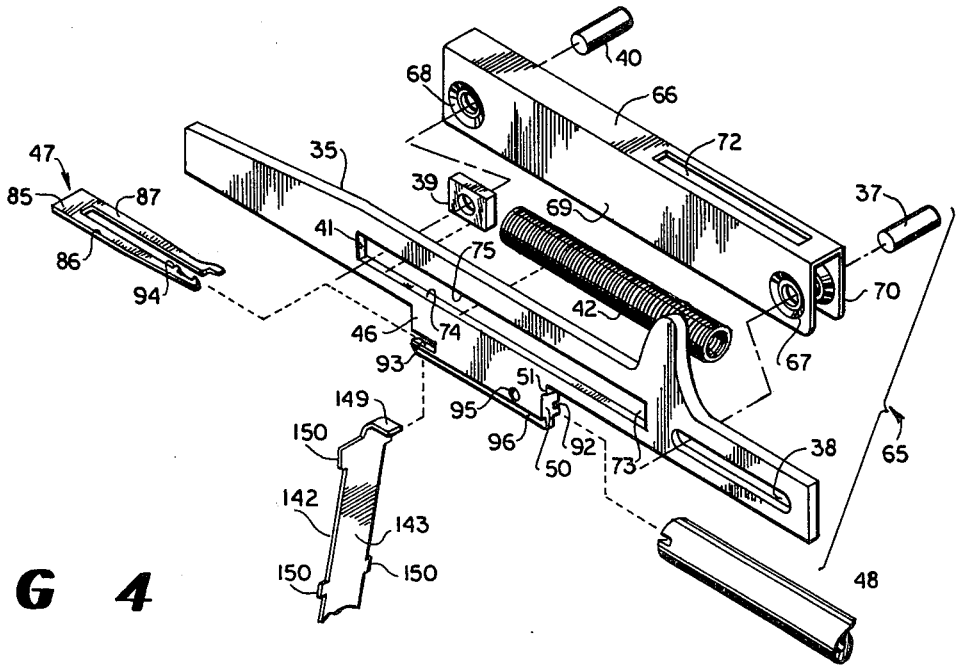
FIG. 4 shows an exploded view of the bolt assembly contained in the receiver assembly of FIG. 3.
Figure 8:
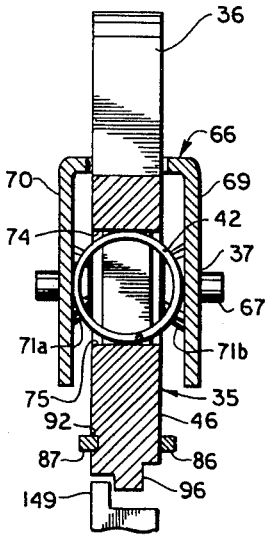
FIG. 8 is a section view taken along line 8—8 of FIG. 3, showing the internal arrangement of the bolt assembly.

Positioned between the receiver plates 55 and 56 is the bolt assembly indicated generally at 65 in FIG. 3 and shown separately in exploded view in FIG. 4. The bolt assembly 65 includes the bolt member 35 disposed within a bolt housing 66 which at least partially surrounds three sides of the bolt, as shown in FIG. 8, and which may be fabricated by appropriate operations including stamping and bending. Each of the first and second dowel pins 37 and 40 extend from the respective slots of the bolt member and through corresponding pairs of openings 67 and 78 formed in the spaced-apart parallel walls 69 and 70 of the bolt housing. Each of the openings 67 and 68 is preferably dimensioned relative to the diameters of the corresponding dowel pins 37 and 40 to permit the dowel pins to provide a snug, noninterference fit, so that the dowel pins can be removed from the bolt assembly without requiring tools. As mentioned previously, the dowel pin 37 and the corresponding first slot 38 in the bolt member defines the maximum forward travel of the bolt member, and so the location in the bolt housing 66 of the opening pair 67 should be precisely defined with respect to the location of the rifle barrel.

The pairs of openings 67 and 68 in the bolt housing are provided on the interiors of the walls 69 and 70 with corresponding pairs of spacing elements which surround such the spacing members surrounding the opening 67 are shown at 71*a* and 71*b* in FIG. 8, and these spacing members may be provided by suitable expedients such as welding separate washer-like spacers in place, by dimpling the metal of the side wall 69 and 70, or the like. It can be seen from FIG. 8 that the areas of the spacing members, including 71*a* and 71*b*, provide the only frictional contact with the bolt member 35. The cocking member 36 extends upwardly through a slot 72 provided in the upper wall of the bolt housing 66.

The operating spring 42 is captured in the slot 41 between the bolt bushing 39 and the end wall 73 of the slot. The diameter of the spring 42, in the disclosed embodiment, is somewhat larger than the thickness of the bolt member 35, so that the sides of the spring 42 make a loose sliding contact along approximately line areas of the interiors of the bolt housing side walls 69 and 70 during reciprocation of the bolt member. At the same time, reciprocation of the bolt member causes sliding contact of the operating spring 42 along another pair of approximately line contact areas where the individual coils of the operating spring contact the bottom wall 74 and the top wall 75 of the slot 41. As a consequence, the movement of the operating spring 42 in compression and expansion during reciprocation of the bolt member is frictionally impeded only along the aforementioned four line contact surfaces. This reduction in the frictional force acting against both the operating spring 42 and the bolt member 35 results in a firearm having an operating action which is significantly faster than provided, for example, by actions in which the bolt slides along machined ways or in which the operating spring is substantially enclosed within a tube or other member causing frictional contact around the periphery of the individual spring coils.

Referring again to the exploded view of FIG. 3, it will be seen that each of the dowel pins 37 and 40 is sufficiently long to extend out of the respective openings 67 and 68, and through the respective openings 77*a*, 77*b* and 78*a*, 78*b* to be retained in a pair of corresponding aligned openings (not shown) disposed in each of the stock halves 17 and 18. The dowel pin openings formed in the two receiver plates 55 and 56 are also dimensioned to permit a snug, non-interfering fit with the respective dowel pins, and it will be understood that the dowel pins 37 and 40 are retained in assembled positions by the aforementioned recesses within each of the stock halves. Thus, the bolt assembly 65 is readily removable from the rifle by separating the two stock halves and then simply manually withdrawing the dowel pins 37 and 40 from the two receiver plates, the bolt housing 66, and the bolt member 35, whereupon the bolt assembly is freed to be removed from the spaced-apart receiver plates.

The receiver plate 56, which is disposed on the right side of the rifle 15, includes an opening 83 which functions as an ejection port for spent cartridges. Since each of the receiver plates 55 and 56 can be identically configured for economy of manufacture, as mentioned above, the receiver plate 55 in the disclosed embodiment contains an opening 84 similar to the ejection port. While the opening 84 is useful to provide ventilation of gases from the chamber, it will be understood that the opening 84 is optional and is nonessential in a firearm designed to eject cartridges in the conventional or right-side manner.

FIRING PIN/EXTRACTOR MEMBER

Figure 9:
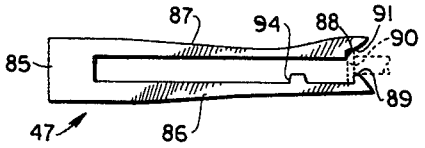
FIG. 9 is a plan view showing a disclosed embodiment of the firing pin/extractor of the present invention.

The firing pin/extractor member 47 is provided by a flat stamping having a base portion 85 and a pair of generally parallel arms 86 and 87 extending outwardly from the base member, as best shown in FIGS. 4 and 9. The firing pin is provided for rimfire cartridges (in the disclosed embodiment) by the projection 88 adjacent the end of the arm 87, and it will be understood by those skilled in the art that the firing pin 88 would be appropriately repositioned for use in a rifle intended to receive center-fire cartridges. The arm 86 includes a right extractor lug 89 in opposition to and spaced a distance 90 beyond the firing pin 88. The left extractor is provided by the surface 91 which is disposed at the end of the arm 87 and which confronts the right extractor 89.

The arm 87 of the firing pin/extractor is mounted in a groove 92 contained along one side of the cartridge moving member 46, and the base member 85 is at least partially received within a slot 93 (FIG. 3) at the rear end of the cartridge moving member. A retaining lug 94 on the arm 86 is received in the aperture 95 of the cartridge moving member 96 to permit a limited extent of fore-aft movement of the firing pin/extractor member relative to the cartridge moving member. It will be appreciated that the relative dimensions of the retaining lug 94 and the aperture 95 are selected so that the firing pin 88 is behind the front face 50 when the firing pin/extractor is positioned rearwardly, and so that the firing pin 88 extends in front of the front face 50 when the firing pin/extractor is positioned forwardly of the cartridge moving member 46.

When a cartridge is positioned in the chamber 49 as described below, the head of the cartridge as shown in phantom in FIG. 9 is positioned between the left extractor 91 and the right extractor 89; the spring action provided by the length of the arm 87 enables the left extractor to maintain the cartridge head engaged behind the right extractor lug 89.

A rib 96 extending downwardly from the lower edge of the cartridge moving member 46 functions to move cartridges from a magazine to the chamber 49, as outlined below.

FIRING MECHANISM AND SAFETY

The firing mechanism assembly of the rifle 15 is best shown in FIG. 5, and the individual components of the firing mechanism are shown in the exploded view of FIG. 3. The firing mechanism includes the hammer 100 mounted for rotation on a pin 101 and biased by the spring 102 toward the position shown by the arrow in FIG. 5. The hammer is retained in the cocked position, shown in FIG. 5, by engagement of the sear notch 103 with the middle finger 104 of the sear bar 105. The sear bar additionally includes a rear finger 106 and a front finger 107, with all three fingers extending substantially transversely of the sear bar 105.

Each of the three sear bar fingers extends through a corresponding pair of slots 108, 109, and 110 formed in the receiver plates 55 and 56, with the sear bar fingers permitted a limited amount of fore-aft movement within such slots. The compression spring 111 acting against the middle finger 104 urges the sear bar 105 and all three fingers toward the rear position.

The middle finger 104 of the sear bar contains a pair of forwardly-facing notches 117 and 118 which retain the spring 111 in place against the middle fingers; the force of the spring 111 pressing into the notches 117 and 118 also serves to retain the sear bar 105 in the firing mechanism assembly.

The hammer 100 includes a holding surface 112 for selective engagement with the rear finger 106, and includes first and second camming surfaces 113 and 114 which enable the hammer to urge forward the spring-biased sear bar fingers 104 and 106 when the hammer is rotated in a counter-clockwise direction as explained below. The hammer 100 additionally includes a striking surface 116 for engaging the base member 85 of the firing pin/extractor member 47, and a holding surface 115 which is positioned to engage a noncritical surface of the middle finger 104 if the hammer is allowed to fall while the bolt assembly 65 is removed from the rifle.

The front finger 107 of the sear bar extends in front of the pushing surface 120 of a trigger 121 pivotally mounted as at 122. The trigger 121 includes a stop surface 123 which contacts a confronting portion of the trigger guard 59 to limit the forward motion of the trigger in response to the springbiased rearward motion of the front finger 107. When the trigger 121 is pulled, the pushing surface 120 contacts the front finger 107 to move this finger, along with the other sear bar fingers 104 and 106, forward against the force of the spring 111. This forward movement causes the middle finger 104 to be removed from the sear notch 103, permitting the hammer 100 to be moved forwardly by the spring 102. This forward movement continues until the striking surface 116 strikes the base member 85 of the firing pin, causing the firing pin 88 to move forward and fire the round in the chamber. When the bolt member 35 is blown backwardly by the fired round, the bolt member moves the hammer 100 in a counter-clockwise direction until the middle finger 104 again engages the sear notch 103. If the pulled trigger has not been released to permit the necessary rearward movement of the sear bar, however, the camming surface 114 of the hammer engages the rear finger 106 to move the sear bar in a rearward direction so that the finger 106 can engage the holding notch 112. When the trigger 121 is finally released, the rear finger 106 is removed from the holding notch 112 and the hammer 100 falls forward to the position where the sear notch 103 engages the properly positioned middle finger 104.

A safety apparatus for the disclosed rifle is provided by a safety lever 125 which is movable around a bushing 126 rotatably disposed on a pin 136 and loosely positioned to be biased toward one end of a slot 127 by the compression spring 128. The safety lever 125 includes a stop notch 129, which is movable to engage and block the bottom of the front finger 107 of the sear bar, and a stop surface 130, which is shown contacting the top of the trigger guard 59.

The safety apparatus additionally includes an actuating member 131 extending downwardly from the pivot bushing 126 through a slot 132 formed in the front of the trigger guard 59. The actuating member 131 terminates in a pair of camming surfaces 133 and 134, which selectively contact the lower end 135 of the trigger guard slot 132.

In the operation of the safety apparatus, it will be seen that the actuating member 131 is normally biased downwardly to place one or the other of the camming surfaces 133 and 134 into contact with the lower end 135 of the trigger guard slot. Assuming that the actuating member 131 and the safety lever 125 are in the position shown in FIG. 5, the sear finger 107 is free to be moved forwardly by the trigger 121 to release the hammer and fire the rifle. A rearward motion applied to the actuating member 131 causes the camming surface 133 to ride along the lower end 135 of the trigger guard slot, with the slot 127 being moved upwardly relative to the bushing 126 and the pin 136. Continued rearward movement of the actuating member 131 causes the camming surface 134 to move onto the lower end 135, at which time the actuating member 131 flips in toggle-action to move the stop notch 129 upwardly to engage and block forward movement of the front finger 107. The safety apparatus thus remains engaged, preventing further firing of the rifle, until the actuating member 131 is again moved forwardly against the toggle action, as by forward movement of a person's finger inserted through the trigger guard 59.

TRIGGER GUARD AND MAGAZINE HOUSING

A housing to receive and retain the cartridge magazine 139 is defined in part by a wall portion 140 formed as an integral extension of the trigger guard 59. The wall portion 140 terminates at a ramp portion 141, which is disposed forwardly to provide a surface directing a cartridge removed from the magazine for movement toward the chamber 49. It is thus seen that the trigger guard 59 provides the functions of partially defining a magazine chamber, a cartridge feed ramp, a safety apparatus retainer, and a trigger positioning device, in addition to the conventional trigger-surround function.

The rear wall of the magazine chamber is formed by a flat metallic stamping 142 including a wall portion 143, a deformed portion 144 which curves rearwardly to contact the interior surface 145 of the stock portion surrounding the magazine housing, a magazine contacting portion 146 including a catch surface 147, and a thumbpiece 148 which extends rearwardly from the lower end of the stamping. The upper end of the stamping terminates in the ejector 149, which is located immediately below the cartridge moving member 46 and to one side of the cartridge feed rib 96 thereon. The stamping 142 may be provided with plural tabs 150 which engage in a corresponding plurality of slots 151 formed in the two receiver plates 55 and 56.

It can be particularly seen in FIG. 5 that a magazine 139 having a notch 152 on its rear side is retained in place by resilient movement of the catch surface 147 into the magazine notch.

OPERATION

Considering the operation of the firearm as described, it is assumed that a cartridge-containing magazine 139 is fully inserted into the magazine housing and that the chamber 49 is presently empty. When the bolt member 35 is moved back by manual movement of the cocking member 36, the cartridge feed rib 96 becomes positioned behind the first cartridge in the magazine, and this rearward movement also moves the hammer 100 to the cocked position shown in FIG. 5. When the cocking member 36 is released, the bolt member is moved forward by the operating spring 42 and the feed rib 96 strips the top cartridge from the magazine to move this cartridge along the ramp 141 and into the chamber 49. During this forward movement of cartridge, the right and left extractors 89 and 91 become engaged with the rim of the cartridge. The firearm is now in condition for firing.

The firing mechanism operates as described above to strike the surface 116 of the hammer against the firing pin/extractor member, moving this member forward on the cartridge moving member 46 to the extent permitted by the free play of the retaining lug 94 within the aperture 95. The resulting forward movement of the firing pin 88 discharges the round, and the bolt member 35 is moved backwardly. The spent cartridge is withdrawn from the chamber 49 by the backward movement of the extractors 89 and 91, the resilient action of the left extractor 91 maintaining the cartridge rim in engagement behind the right extractor lug 89. This backward movement of the spent cartridge continues until the underside of the cartridge is forced against the ejector 149, as seen in FIGS. 5 and 8, whereupon the cartridge is dislodged from the extractors and ejected out of the ejection port 83 in the receiver plate 56. The rearward movement of the bolt member 35 continues until the hammer 100 is again cocked and the front end of the slot 38 contacts the dowel pin 37, whereupon the operating spring 42 forces the bolt member forward and the loading cycle repeats.

FRONT AND REAR SIGHTS

Figure 10:
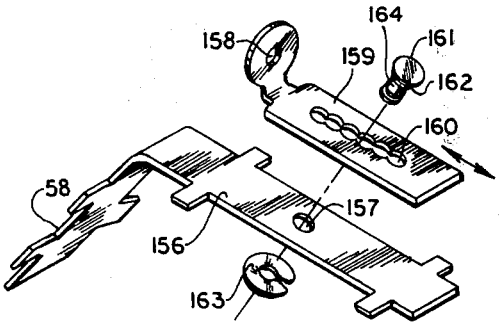
FIG. 10 shows an exploded view of the rear sight according to the disclosed embodiment of the present invention.

The rear sight of the type providing a "click" elevation adjustment is provided, according to the present invention, as another function of the receiver plate spacing element 58. The forward portion of the spacing element 58, shown in detail in FIG. 10, provides a ramp 156 disposed on a slope relative to the boresight of the rifle barrel 48, and an opening 157 is formed in the ramp. The actual rear sighting element, in the disclosed embodiment, is provided by the peep sight opening 158 mounted to extend upward from the sight slide 159. The sight slide 159 contains a plurality of contiguous overlapped openings 160, and the sight slide is attached to the ramp 156 with a fastener 161 having a conical surface 162. The shank 164 of the fastener 161 passes freely through the openings 160 and the opening 157 in the ramp 156, and is retained with the conical surface 162 drawn into one of the openings 160 with inclined movement by the resilient force of a fastening member such as the retaining ring 163 having the cross section shape of a conic section.

Movement of the sight slide 159 in either direction along the ramp 156 provides a number of "click" elevation adjustments for the sight opening 158 as the conical surface 162 moves between the adjacent ones of the openings 160. A rear sight is thus provided which affords click-elevation adjustment at relatively little additional cost and which also utilizes the spacing element 58, an integral part of the disclosed embodiment of the invention. The upper end of the receiver plate ears 61 and 62 (FIG. 2) shield and define the region in which the sight opening 158 moves.

Figure 11:
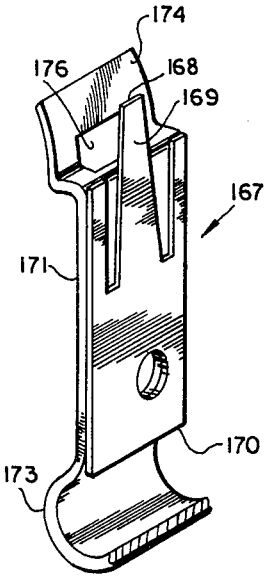
FIG. 11 shows a partial view of the front sight according to the disclosed embodiment of the present invention.

Considering the front sight 167 as shown in FIGS. 1, 2, and 11, the actual visual sighting function is provided by the end 168 of a blade 169 which extends downwardly to a lower end 170 preferably secured permanently as by welding or the like to the exterior of the rifle barrel 48. The blade 169 is surrounded on the left and right sides by a pair of protective members 171 and 172, which may be fabricated from a single piece of metal to include a looped portion 173 disposed around and secured to the rifle barrel 48. Each of the protective members 171 and 172 terminates in a protective ear 174 and 175, respectively, with these ears being spaced apart from the sight end 168 to define and protect this sight.

The protective members 171 and 172 include adjustment openings, one of which is shown at 176, through which the blade 169 can be contacted with a suitable tool to be bent. It is contemplated that the front sight 167, once initially installed during the manufacture of the rifle, would be sighted-in by bending the blade 169 as necessary to achieve the proper horizontal location for the sight end 168. The protective members 171 and 172, including the ears 174 and 175, protect and substantially surround the blade 169 to protect this blade from becoming easily damaged or otherwise misaligned from any physical contact with the blade. Even if damage occurs in some manner, the blade 169 can again be bent to sight-in the rifle.

Although the foregoing disclosure of an embodiment of the present invention sets forth a complete firearm having numerous operating assemblies and features, it will be apparent to those skilled in the art that many of these features can be applied separately to firearms of different overall design without detracting from the operation and the advantages afforded by each particular assembly. For example, it will be understood that a firearm could be provided having a bolt assembly according to the present invention, without requiring a firing mechanism as disclosed herein. Similarly, a safety apparatus according to the present invention could be provided for many different types of firearms.

The overall firearm design of the present invention permits extensive use of components which can be manufactured by relatively inexpensive techniques such as stamping, bending, and the like, and which require little or no precision machining, apart from portions such as the bolt member and the dowel pins as aforementioned. A firearm thus can be provided according to the present invention which is inexpensive and light of weight, and which additionally provides a low-friction action which is rapid, dependable, and easily broken down for cleaning or other purposes. In the disclosed embodiment of the invention, for example, the complete action consists of four basic moving parts: the bolt member, the hammer, the sear bar, and the trigger.

Moreover, it will be apparent to those skilled in the art that only a preferred embodiment of the present invention is disclosed, and that numerous modifications and alterations may be made therein without departing from the spirit and scope of the invention as defined in the claims.

What is claimed is:

1. Sighting mechanism for use with a firearm of the type firing a projectile along a path, comprising:

a first member mounted on the firearm to define a ramp disposed in angular relation to the path of projectile travel;

a second member mounted for selective movement along said ramp;

said second member having a structural portion defining a visual sight;

a plurality of intersecting apertures contiguously disposed on one of said first and second members;

an engagement member disposed on the other of said first and second members for selective inclined movement into and out of retaining engagement with each individual one of said plurality of apertures to retain said second member in each of a plurality of discrete positions relative to said first member;

resilient means yieldingly biasing said engagement member into engagement with a one of said apertures and yieldable in response to predetermined force applied to said second member for inclined movement out of said retaining engagement, so that said engagement member can be selectively moved for retaining engagement with the next contiguous one of said apertures;

said second member having an elongate portion which is movable along said ramp, and said plurality of apertures being disposed along said elongate portion;

said first member having an aperture which is selectively alignable with each individual one of said plural apertures as said second member is moved along said ramp; and said engagement member extending through said aperture in said first member and into said retaining engagement with an individual one of said plural apertures.

2. Sighting mechanism as in claim 1, wherein:

said engagement member includes a cam portion resiliently biased to enter any one of said intersecting apertures and yieldable for withdrawal from one such aperture so that said engagement member can be positioned for entry into the next such aperture in response to said predetermined force applied to said second member.

3. Sighting mechanism as in claim 1, wherein:

said first member comprises a flat surface to define said ramp; and said second member comprises a flat surface in sliding contact with said flat surface of said ramp.

4. Sighting mechanism as in claim 3, wherein each of said sliding flat surfaces is smooth.

* * * * *